United States Patent [19]

Markey et al.

[11] 4,425,742

[45] Jan. 17, 1984

[54] BUILDING CONSTRUCTION AND PURLIN HANGER THEREFOR WITH METHOD OF CONSTRUCTION

[75] Inventors: Dennis P. Markey, West Bloomfield; George J. Rosen, Franklin, both of Mich.

[73] Assignee: Markey Brothers Co., Walled Lake, Mich.

[21] Appl. No.: 360,078

[22] Filed: Mar. 19, 1982

Related U.S. Application Data

[63] Continuation of Ser. No. 155,381, May 30, 1980, abandoned.

[51] Int. Cl.[3] ..... E04B 7/02

[52] U.S. Cl. ..... 52/90; 52/262

[58] Field of Search ..... 52/86, 90, 92, 262, 52/79.1

[56] References Cited

U.S. PATENT DOCUMENTS

| | | | |
|---|---|---|---|
| 537,505 | 4/1895 | Van Dorn . | |
| 625,427 | 5/1899 | Stewart et al. . | |
| 804,451 | 11/1905 | Carlson . | |
| 828,488 | 8/1906 | Lanz . | |
| 1,082,937 | 12/1913 | Douglass . | |
| 1,452,599 | 4/1923 | Hames . | |
| 2,990,590 | 7/1961 | Graveley . | |
| 3,036,347 | 5/1962 | Findleton . | |
| 3,394,961 | 7/1968 | Matte . | |
| 3,420,560 | 1/1969 | Pfahming . | |
| 3,421,270 | 1/1969 | Chamey | 52/90 |
| 3,442,057 | 5/1969 | Derr | 52/90 |
| 3,447,823 | 6/1969 | Gregoire . | |
| 3,633,950 | 1/1972 | Gilb . | |
| 3,646,716 | 3/1972 | Jenner | 52/90 X |
| 3,837,135 | 9/1974 | Zachman | 52/702 |
| 3,932,969 | 1/1976 | Matras | 52/86 |
| 3,942,290 | 3/1976 | O'Sheeran | 52/90 X |
| 3,943,672 | 3/1976 | O'Sheeran | 52/90 X |
| 3,971,176 | 7/1976 | Rannels | 52/86 |
| 3,999,338 | 12/1976 | Behan et al. | 52/92 |
| 4,003,167 | 1/1977 | Saunders | 52/92 |
| 4,011,697 | 3/1977 | Fedolfi | 52/90 |
| 4,047,346 | 9/1977 | Alderman | 52/90 X |
| 4,115,967 | 9/1978 | Kragt | 52/90 |

FOREIGN PATENT DOCUMENTS

| | | | |
|---|---|---|---|
| 468708 | 7/1972 | Australia . | |
| 968124 | 5/1975 | Canada | 52/90 |
| 830832 | 2/1952 | Fed. Rep. of Germany . | |
| 2611236 | 9/1977 | Fed. Rep. of Germany . | |
| 2911427 | 9/1980 | Fed. Rep. of Germany | 52/92 |
| 939923 | 5/1948 | France . | |
| 1007078 | 2/1952 | France . | |

*Primary Examiner*—J. Karl Bell

*Attorney, Agent, or Firm*—Harness, Dickey & Pierce

[57] ABSTRACT

A building construction comprised of front and rear planar supports having purlins spanning between the supports and attached to the supports by hangers attached to the outside surfaces of the supports, i.e. the surface of the support opposite the surface generally adjacent to the purlin. The hanger comprises a seat to which each purlin is connected, and two arms integrally secured to the seat. The arms include integrally formed nails which attach to the surface opposite the surface adjacent to the seat portion of the hanger. Notches are included at the periphery of the support through which the arms of the hangers are hung. The method of construction involves setting up a floor, attaching and bracing the planar supports, hanging and attaching the purlins, taking away the braces, and adding the roof, sidewalls, and other parts to provide a building construction to be used as a storage hut or the like.

7 Claims, 10 Drawing Figures

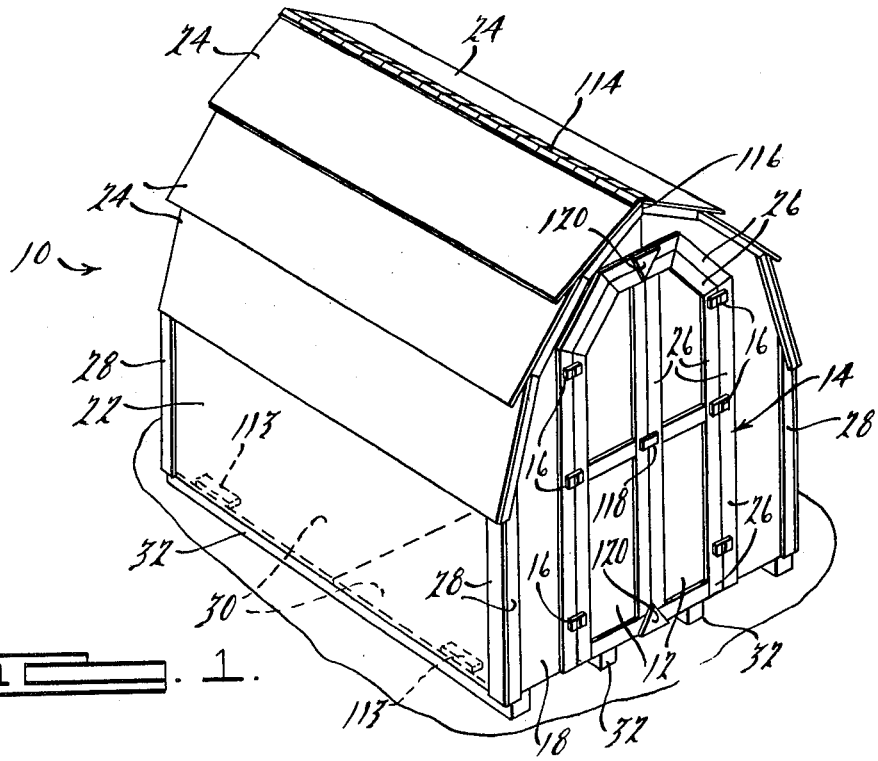
FIG. 1.
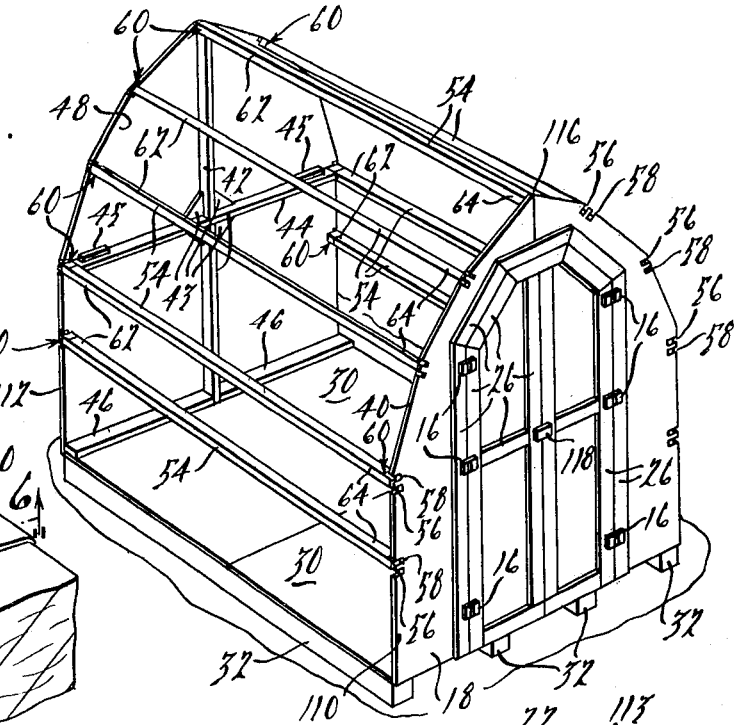
FIG. 2.
FIG. 5.
FIG. 2A.

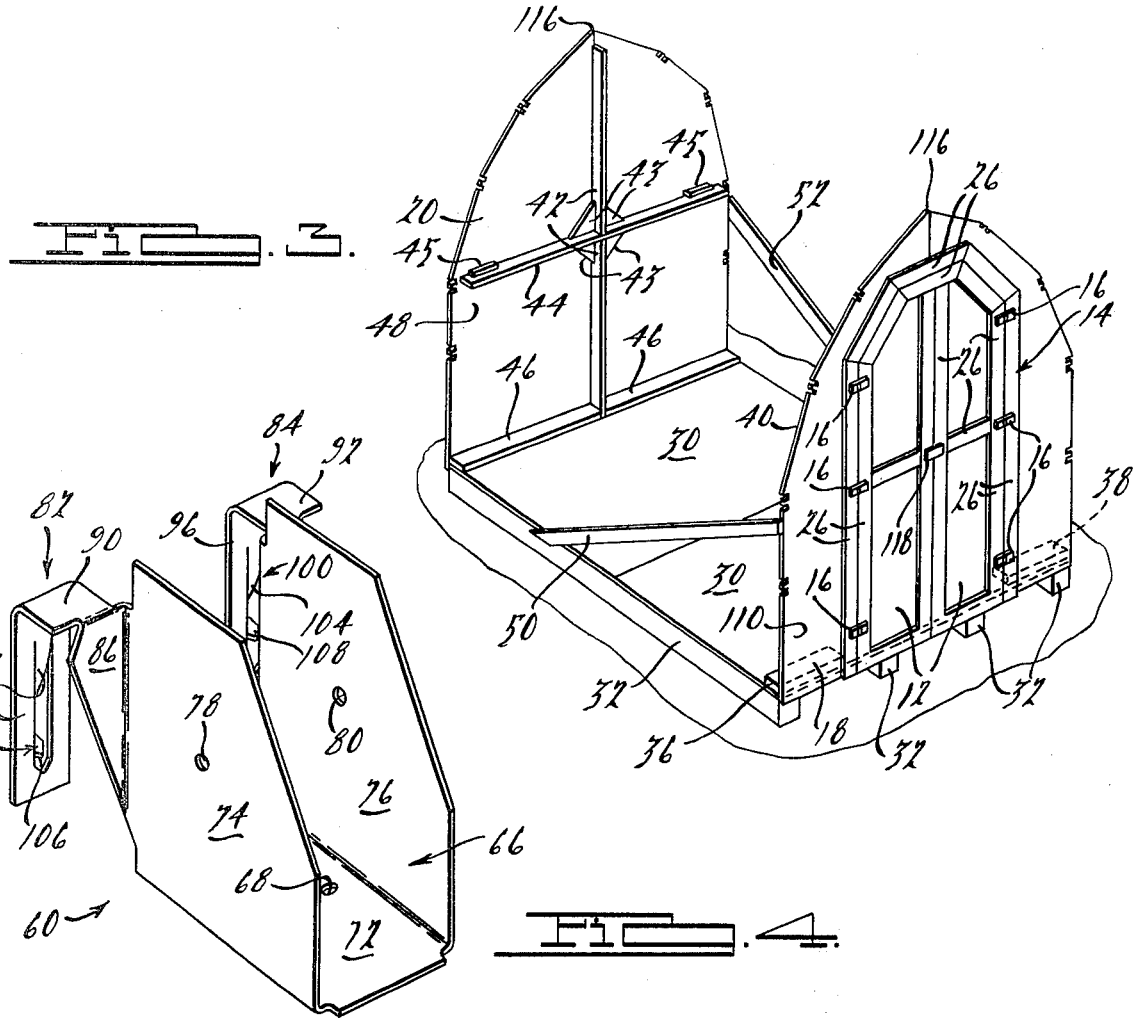
FIG. 3.
FIG. 4.
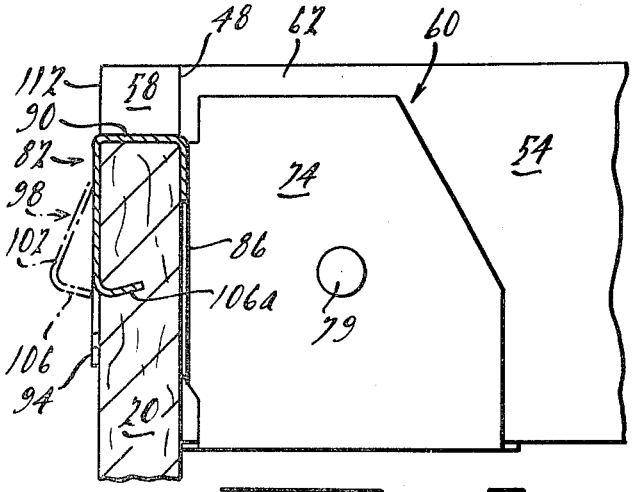
FIG. 6.
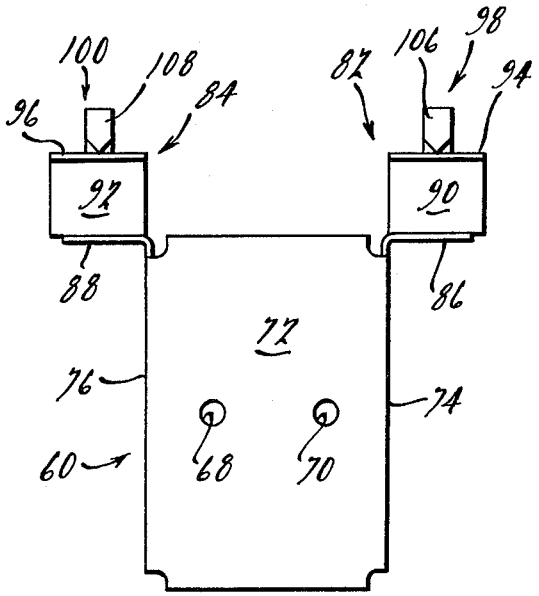
FIG. 7.

BUILDING CONSTRUCTION AND PURLIN HANGER THEREFOR WITH METHOD OF CONSTRUCTION

This is a continuation, of Application Ser. No. 155,381, filed May 30, 1980 now abandoned.

BACKGROUND AND SUMMARY OF THE INVENTION

The present invention relates generally to easy to construct building assemblies and particularly to an improved assembly utilizing an improved joist or purlin hanger in construction of the building.

Relatively small, easy to construct buildings, commonly called sheds, huts, shanties, shelters, or the like, have been desirable throughout the ages of man for protective storage of implements, small vehicles, animals, and many other things which do not require the full level of comfort of a house with its attendant features of heating, plumbing, etc. To be useful, such buildings must be sturdy, be able to withstand a variety of weather conditions, and generally be capable of having a long life with a minimum of upkeep. It also has been generally desirable for such buildings to maintain a relatively aesthetically appealing appearance with a minimum of maintenance. By far the most important feature, however, is ease of construction so that a person of even limited mechanical aptitude or craftsmanship may construct the building in a minimum of time and effort.

Accordingly, one object of the present invention resides in the provision of a building assembly requiring a minimum of time and effort to build even if the builder has minimal mechanical aptitude or craftsmanship ability. It is a further object to provide the ease of construction to result in a sturdy and weather-resistant structure, generally capable of long life with a minimum of upkeep.

Hinged wooden doors are desirable to use in such a hut construction due to simplicity of construction and low costs. Such doors, however, have problems with racking. Accordingly, it is a further object of the present invention to provide a door design for the present construction to reduce the likelihood that racking occur and maintain a functionally and aesthetically appealing structure.

BRIEF DESCRIPTION OF THE DRAWINGS

FIG. 1 is an elevated perspective view of the finished building of the present invention;

FIG. 2 is an elevated perspective view of the building of FIG. 1 at an intermediate stage of construction;

FIG. 2*a* is an elevated top view of an alternative floor to be used with the building of FIG. 1;

FIG. 3 is an elevated perspective view of the building of FIG. 1 at an intermediate stage of construction prior to that shown in FIG. 2;

FIG. 4 is a perspective view of a joist hanger of the present invention;

FIG. 5 is an enlarged partial view of the construction of FIG. 2 illustrating the hanger, purlin, and planar support in operable association;

FIG. 6 is a sectional view of the construction of FIG. 5 along the line 6—6;

FIG. 7 is a bottom view of the joist hanger of FIG. 4;

DESCRIPTION OF THE PREFERRED EMBODIMENT

Figure 8:
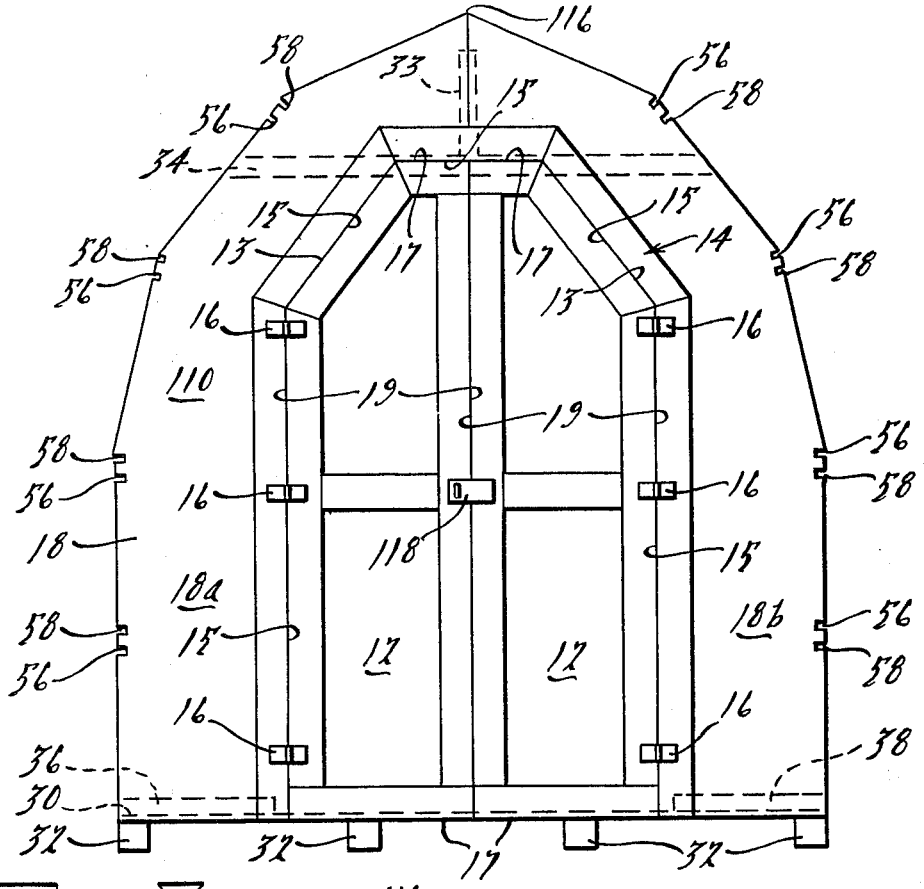
FIG. 8 is an elevated front view of the front wall of the building of FIG. 1.

Referring to FIGS. 1, 2 and 3, a building construction 10 within the scope of the present invention is illustrated. FIG. 1 illustrates the building 10 as constructed in its final form. Included in the finished building 10 are doors 12 mounted on hinges, generally designated 16, indoor frame 14, front 18 and rear 20 supports, each comprised of two sections, designated 18*a* and 18*b* and 20*a* and 20*b*, respectively, generally planar in configuration and hereinafter called walls with respect to the preferred embodiment, side wall members 22, roof panels 24, door and door frame trim 26, edge trim 28, and a plywood floor 30 on floor joists 32. Alternatively, the floor 30*a* may be a concrete slab with locator cleats 31*a*, 32*a*, and 33*a* located either adjacent the inside surfaces of the walls 18, 20, and 22 (FIG. 2*a*) or supporting them from below, or any other arrangement as known in the art.

Figure 9:
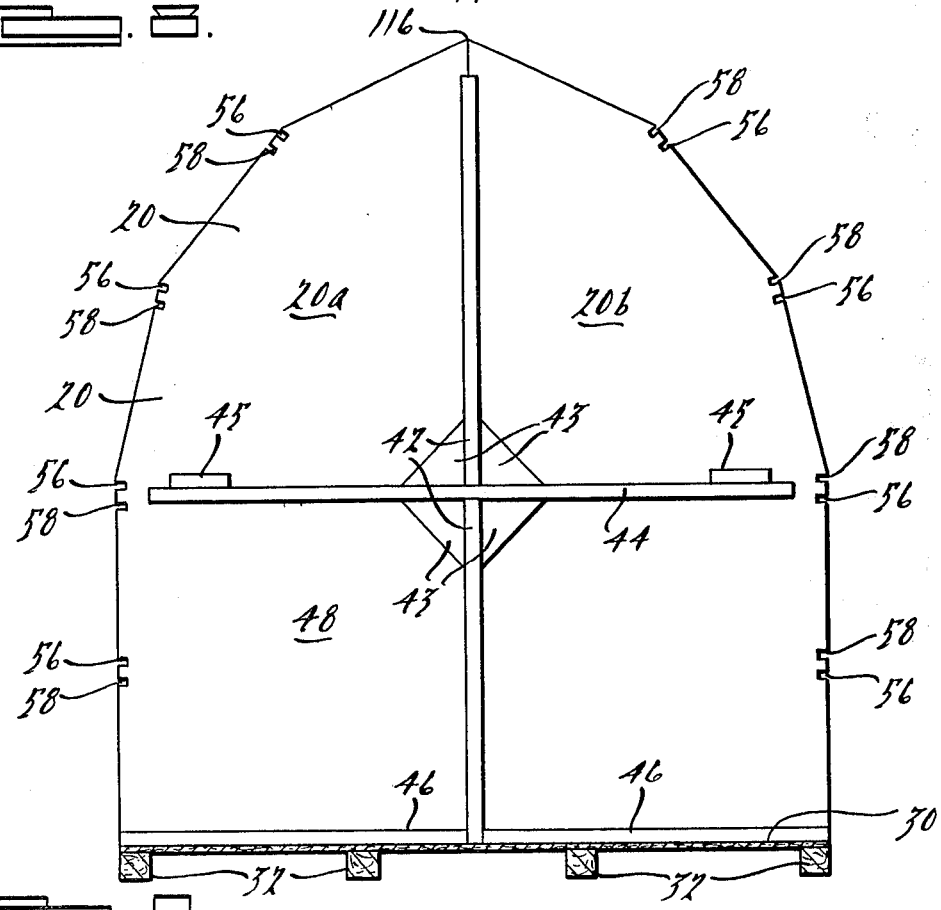
FIG. 9 is an elevated front view of the rear wall of the building of FIG. 1.

FIGS. 2 and 3 illustrate the building 10 in intermediate stages of construction. Initially, the floor 30 is secured to the joists 32. The front wall sections 18*a* and 18*b* are connected at support member 33 (FIG. 8), and a door stop 34 and locator members 36 and 38 are attached to the inner surface 40 of the front wall 18, as shown in FIG. 8, after the doors 12 and 14 have been cut out and attached by hinges 16. The door and door frame trim 26 may be added at any time, but is usually preassembled on said front wall 18 or added prior to cutting out and hinging the doors. Rear wall sections 20*a* and 20*b* are secured together by vertical 42 and horizontal 44 braces secured to the inner surface 48 of the rear wall 20, as shown in FIG. 8. The vertical 42 and horizontal 44 braces are aligned by four triangular shaped locator members, generally designated 43, and horizontal locator blocks 45, all of which are usually preassembled on said rear wall sections 20*a* and 20*b*. Floor locator members 46 are likewise secured to said rear wall 20 as shown in FIG. 9. The front wall 18 is then attached to the floor 30 and a brace 50 is temporarily secured between the floor 30 and the wall 18. The procedure is then repeated for the rear wall 20 and the temporary brace 52 to arrive at the construction shown in FIG. 3. In the preferred embodiment, the locator members 36, 38, and 46 locate the front wall 18 and rear wall 20 in an overlapping relationship with the floor 30 to decoratively cover the outer edges of the floor 30.

The doors 12 each have five sides including a diagonal or canted upper portion 13 in the preferred embodiment. The diagonal portions 13 keep the doors 12 from racking to remain both more functionally and aesthetically appealing, while also having spaced apart horizontal 17 and vertical edges 19 to align the doors conventionally and utilize conventional hinges 16, as shown in FIG. 8. The door frame 14 has edges 15 parallel to each of said door edges 13, 17, and 19. The diagonal portions 13 of the doors 12 meet the hinged vertical edges 19 of the doors 12 above the uppermost of the hinges 16 and generally form an angle of thirty to sixty degrees with the line formed with a horizontal edge 17 of the door 12.

The next step involves hanging the purlins, generally designated 54, from the front wall 18 to the rear wall 20. Referring to FIGS. 8 and 9, pairs of notches 56 and 58 are located at spaced intervals along the periphery of front wall 18 and rear wall 20, respectively. Purlin hangers 60 are attached to both ends 62 and 64 of each purlin 54 and are inserted in the notches 56 and 58 to properly locate and attach the purlins 54 along the periphery of the front 18 and rear 20 walls. The braces 50 and 52 are removed after the purlins 54 have been hung. At the peak 116, a purlin 54 is hung from the top of vertical brace 42 on the rear wall 20 to the top of support member 33 on the front wall 18 and secured by suitable nail fasteners, although a notch and hanger arrangement could readily be utilized.

The hangers 60, referring to FIGS. 4, 5, 6, and 7, are preferably a one-piece sheet metal construction having a seat 66 which has means, such as apertures 68 and 70 in bottom section 72 (FIG. 7), through which the hanger 60 can be secured to a purlin 54 by a suitable fastener, such as a conventional nail. Sidewalls or flanges 74 and 76 extend upwardly generally perpendicularly from the bottom section 72 to form the seat 66. The flanges 74 and 76 also have means, such as apertures 78 and 80, respectively, to additionally secure the hanger 60 to the purlin 54 by a suitable fastener, such as nail 79. C-shaped arms 82 and 84 are integrally attached to the flanges 74 and 76 of the seat 66. Support flanges 86 and 88 extend generally perpendicularly from the sidewalls 74 and 76, respectively, from which top sections 90 and 92 extend. Attachment flanges 94 and 96 extend downwardly and substantially perpendicularly from said top sections 90 and 92 respectively. The top sections 90 and 92 extend to form surfaces in substantially the same plane, substantially parallel with the plane formed by the bottom section 72, and generally perpendicularly from the plane formed by the support flanges 86 and 88. Attachment flanges 94 and 96 extend substantially parallel to the plane formed by support flanges 86 and 88. Top sections 90 and 92 engage the notches 56 and 58 when the hanger 60 is located in its proper position. Nails 98 and 100 are integrally formed within the flanges 94 and 96 respectively. The nails 98 and 100 are comprised of head flanges 102 and 104, respectively, and generally perpendicularly situated nail point flanges 106 and 108.

One hanger 60 is attached to each end 62 and 64 of purlin 54 by suitable fasteners and the purlin 54 is located as a span between the front 18 and rear 20 walls by the insertion of the top sections 90 and 92 of the arms 82 and 84 of the hanger 60 into the notches 56 and 58 at the periphery of the front and rear walls 18 and 20. Attachment flanges 94 and 96 will then be located adjacent the outer surface 110 of front wall 18 or the outer surface 112 of rear wall 20. The purlin 54 and hanger 60 are secured by driving nail point flanges 106 and 108 through the associated outer surface into engagement with the associated front or rear wall 18 or 20, as illustrated in FIG. 6 by nail point flange 106*a*.

After all of the purlins 54 are secured, referring to FIG. 1, the sidewall members 22 are attached. The sidewalls 22 have locator members 113 at the lower portions thereof (FIG. 1) to locate the sidewalls 22 in an overlapping relationship with the floor 30 to decoratively cover the outer edges of the floor 30. The roof panels 24 are then attached and edge trim 28 is added. The edge trim 28 will cover the attachment flanges 94 and 96 of the hangers 60, which would otherwise be exposed, and will provide an aesthetically appealing appearance. The roof panels, walls, and trim are preferably made of wood and may be painted or stained at any time in the construction process, either before or after mounting. Ridge shingles 114 may be added at the peak 116 of the roof to provide a better weather seal at that point and a more aesthetically pleasing appearance. Attachment of a conventional door latch 118 and outer door stops 120 (FIG. 1) generally completes the construction of the building.

The purlin hanger arrangement of the present invention is particularly noteworthy for its elimination of any rafters or the like attached to the inner surfacs of the periphery of front and end walls 18 and 20. Roof support frames having cross joists are also not necessary with the construction of the present invention, but may be readily added is so desired and the hanger 60 of the percent invention may also be used to support the joists or rafters between the purlins 54.

While it will be apparent that the preferred embodiment disclosed is well calculated to fulfill the objects above stated, it will be appreciated that the invention is susceptible to modification, variation, and change without departing from the propr scope or fair meaning of the subjoined claims.

What is claimed is:

1. A building construction for a storage hut comprising:

two planar supports, each having an interior surface facing the other support, an exterior surface facing away from the other support, and a periphery extending along the top and two sides thereof;

purlins extending between said planar supports at selected locations;

hanger means for spanning said purlins between said supports comprising seat means for supporting said purlins having means to attach said purlins to said hanger, integral nail means for attaching said hanger to the exterior surfaces of said planar supports, and arm means for connecting said seat means and said attachment means, wherein said purlin is secured to each said planar support by hanging said hanger means over the edge of said planar support and attaching said nail means through the exterior surface of said planar support into said planar support; and means for locating and holding said hanger means in a proper position along the periphery of said planar support for accurate disposition of said purlins prior to attaching said hanger means to said exterior surface of said support by said integral nail attaching means.

2. A construction in accordance with claim 1 wherein said planar supports have means for locating each said purlin comprising notch means extending from said interior surface to said exterior surface of each of said planar supports and each of said arm means is operably associated with a corresponding one of said notch means when each said purlin is located in its operable position attached to said planar supports.

3. A construction in accordance with claim 2, wherein said planar supports are the front and rear walls of said construction and the front wall includes means to enter said building construction.

4. A construction in accordance with claim 3, wherein said construction further comprises floor means and locator means for locating and attaching said front and rear walls to said floor means.

5. A building construction for a storage hut comprising:

two planar supports, each having an interior surface facing the other support, an exterior surface facing away from the other support, and a top portion extending between said interior and exterior surfaces;

purlins extending between said planar supports at selected locations;

hanger means for spanning said purlins between said supports comprising means for interfacing said exterior surface of said support, seat means for supporting said purlins having means to attach said purlins to said hanger, and attachment means interacting with said exterior surfaces for attaching said hanger and said purlins to said planar supports; and means extending in a plane substantially parallel to a line formed by each of said purlins when said purlins are operably disposed between said supports and disposed on one of said hanger means or one of said supports for locating and holding each said hanger and purlin properly in position relative to each said planar support and for interacting each said hanger with each said support;

wherein said purlin is secured to each said planar support by hanging said hanger means onto said planar support and attaching said attachment means to the exterior surface of said planar support.

6. A construction in accordance with claim 5 wherein said hanger means further comprises arm means and said locating and interacting means comprises at least one notch which interacts each said arm means with each said support.

7. A building construction for a storage hut comprising:

two planar supports, each having an interior surface facing the other support, an exterior surface facing away from the other support, a top portion extending between said interior and exterior surfaces, and two side portions extending between said interior and exterior surfaces and disposed on opposite sides of said top portion;

purlins extending between said planar supports at selected locations;

hanger means for spanning said purlins between said supports comprising means for interfacing said exterior surface of said support, seat means for supporting said purlins having means to attach said purlins to said hanger, and attachment means interacting with said exterior surfaces for attaching said hanger and said purlins to said planar supports; and means extending in a plane substantially parallel to a line formed by each of said purlins when said purlins are operably disposed between said supports and disposed on one of said hanger means or one of said supports for locating and holding each said hanger and purlin properly in position relative to each said planar support and for interacting each said hanger with each said support;

said means for locating and holding being disposed on each said planar support at locations on the top portion and side portions thereof;

wherein said purlin is secured to each planar support by hanging said hanger means onto said planar support and attaching said attachment means to the exterior surface of said planar support.

* * * * *